United States Patent [19]

Reynolds

[11] Patent Number: 5,067,293

[45] Date of Patent: Nov. 26, 1991

[54] BUILDING SYSTEM

[75] Inventor: Donald A. Reynolds, Bradford, England

[73] Assignee: Don Reynolds International Limited, Bradford, Great Britain

[21] Appl. No.: 565,376

[22] Filed: Aug. 9, 1990

[30] Foreign Application Priority Data

Aug. 16, 1989 [GB] United Kingdom ..... 8918707

[51] Int. Cl.[5] ..... E04C 2/40

[52] U.S. Cl. ..... 52/235; 52/475

[58] Field of Search ..... 52/235, 475, 573

[56] References Cited

U.S. PATENT DOCUMENTS 3,436,887 4/1969 Grossman ..... 52/235

*Primary Examiner*—David A. Scherbel
*Assistant Examiner*—Wynn Wood
*Attorney, Agent, or Firm*—Darby & Darby

[57] ABSTRACT

A curtain wall systems includes a joint member having a formation adapted to be secured to a mullion and a projection arranged to extend horizontally of the joint member in use and dimensioned to be received within a transom. Bearing surfaces of the projection are coated with a low friction material such as polypropylene and arranged so that the transom may more relative to the joint upon thermal expansion or contraction.

10 Claims, 2 Drawing Sheets

BUILDING SYSTEM

BACKGROUND OF THE INVENTION

This invention relates to a curtain wall system for cladding of buildings and in particular to methods of joining metal members used for construction of window frames or other panels for such cladding.

In or U.S. Pat. No. 4,631,884 there is described a novel wall system which comprises an auxiliary framework attached to the main steel work of a building and made of a plurality of framework members. Each such framework members has a generally T shaped cross section and includes an elongated central support portion defining a pair of opposed shoulders for seating the edges of a pair of adjacent infill panels. The framework member has a channel generally parallel with the support portion and shaped to receive and grip the foot of a flexible gasket, the gasket having a transverse limb adapted to extend toward or over the associated shoulder to bear against the infill. The thickness of any given infill may be substantially the same as the cross sectional length of the support portion of the associated framework member. The term "curtain wall" as used herein is intended to cover systems of this type as well as conventional curtain wall systems.

One advantage of the system above described is the flexibility accorded the system to enable subsequent alterations and/or extensions to be accommodated. Thus the removal of one gasket allows its associated infill to be removed and replaced with, for example, an infill bearing an opening window, without disturbing adjacent infills or rention devices. (The term infill includes a construction panel, glazing unit, or the like which is capable of being used as cladding for a building, that is to constitute the internal and external walling for a building.)

Construction of curtain walling from extruded metal members has previously involved use of brackets or jointing blocks which are secured to the abutting members by screws or bolts. Such arrangements have the disadvantage that diurnal thermal movements create noise and cause annoyance to occupants of the building.

SUMMARY OF THE INVENTION

According to the present invention a curtain wall system includes a jointing member having a formulation adapted to be secured to a vertical member and a projection arranged to extend horizontally of the jointing member in use and dimensioned to be received with a horizontal member, bearing surfaces of said projection being formed from a low friction material and being arranged so that the horizontal member may move relative to the joint member upon thermal expansion or contraction of the panel horizontal member.

Use of the building system of this invention not only avoids the noise created by diurnal movement of members which are secured together, but also confers a number of other advantages. Avoidance of the need to screw or bolt the horizontal member to the joint makes it unnecessary to drill holes in the horizontal member.

The low friction material is preferably a covering of a plastics material, for example, polyethylene, polyproplene, nylon or polytetrafluroethylene.

Said formation may be provided with apertures of which screws, bolts, rivets or other fixtures may be engaged with the vertical member. The formation is preferably arranged to engage the vertical member without need for routing or otherwise cutting the latter. The routing operation, which requires a separate manufacturing step, is extremely noisy and causes inconvenience to workers. Processing within the factory is quicker and more efficient and assembly on site is simplified.

BRIEF DESCRIPTION OF THE DRAWINGS

The invention is further described by means of example but not in any illustrative sense with reference to the accompanying drawings.

DESCRIPTION OF THE PREFERRED EMBODIMENTS

Figure 1:
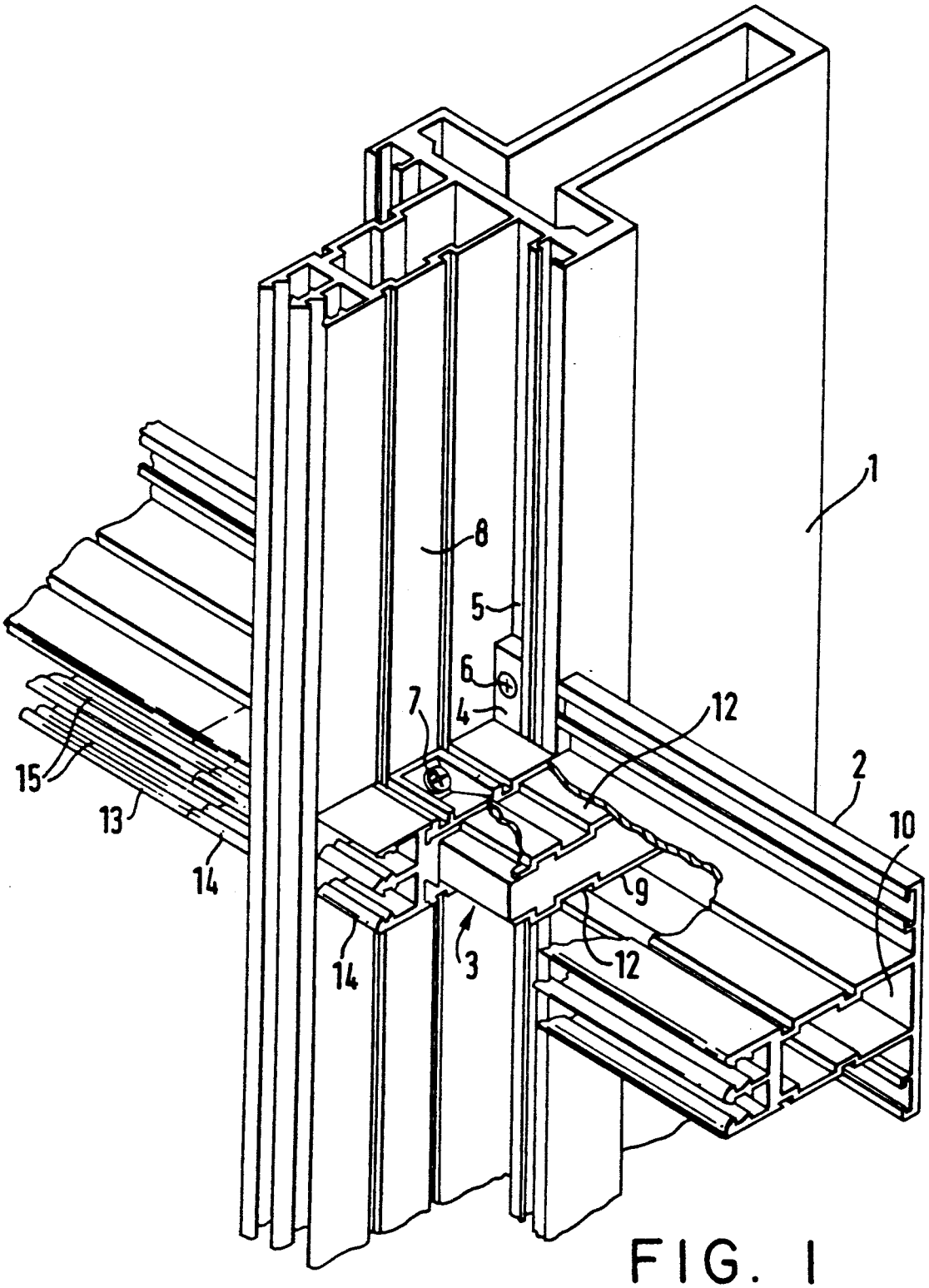
FIG. 1 is a partially cut away view illustrating use of a joint in accordance with this invention.
Figure 2:
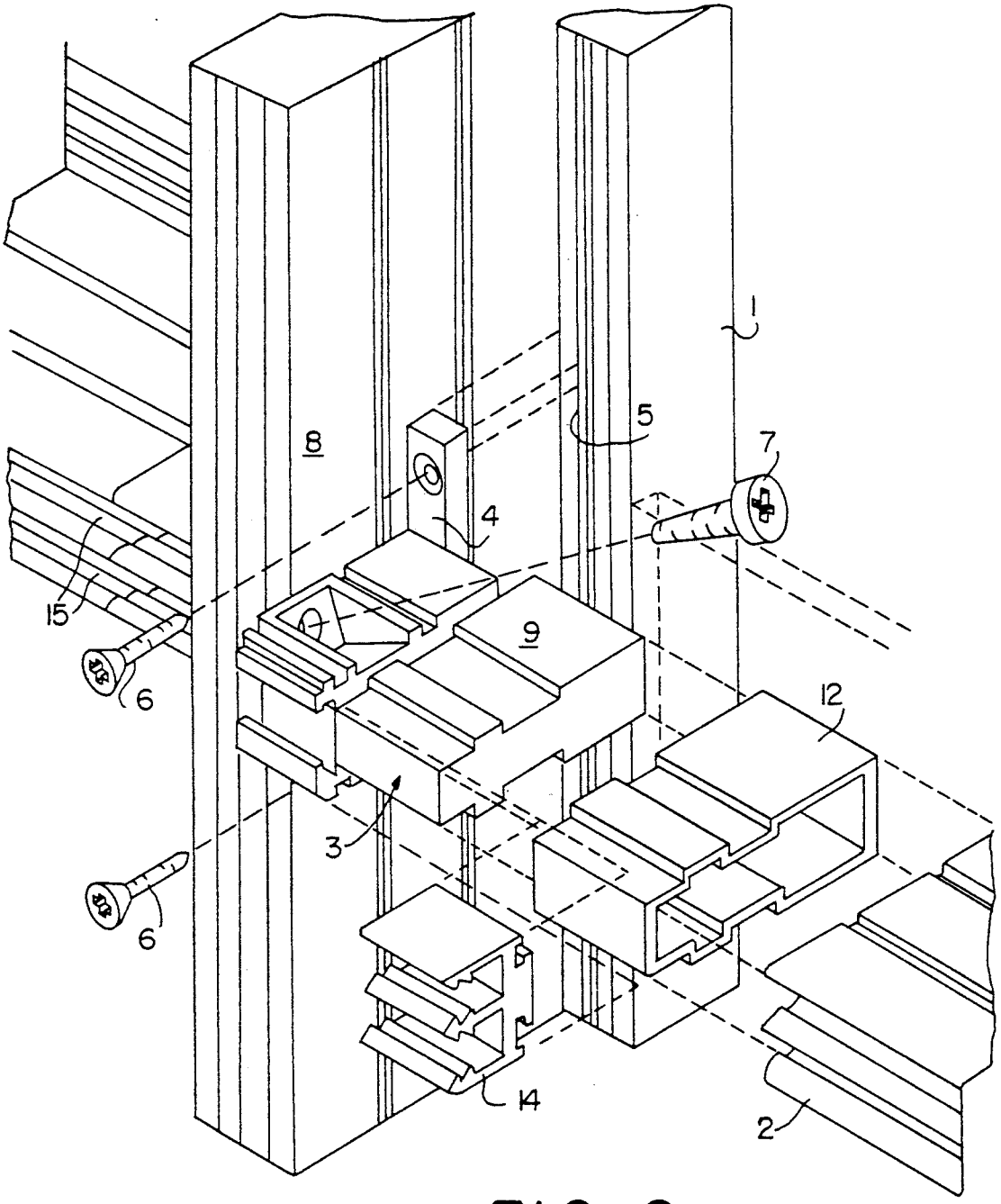
FIG. 2 is an exploded view, in perspective, of the joint of FIG 1.

FIGS. 1 and 2 illustrate connection of a mullion 1 to a transom 2, both mullion and transom being formed from extruded aluminum in the conventional manner. The joint member 3 includes a formation 4 dimensioned to be received in a recess 5 of the mullion 1. A screw 6 received in an aperture (not shown) drilled in the recess 5 secures the joint in position. The construction of the joint 3 allows engagement with the mullion 1 without need for routing a channel in the latter. The screw 7, engaged in an aperture of the outwardly projecting portion 8 of the mullion serves to further secure the joint. A laterally extending projection 9, coated with a layer of polypropylene 12 or other low friction material, for example polyethylene, nylon or polytetrafluoroethylene, is dimensioned to be received in an internal channel 10 of the transom 2. Engagement between the channel 10 and projection 9 is sufficient to locate the transom correctly while allowing lengthwise expansion or contraction of the latter relative to the joint 3. An extruded member 13 slidably engaged by means of a tongue and groove fitting to the outer edge of the transom 2, or integral thereto, abuts a corresponding extruded member 14 which is similarly slidably engaged with the joint member 3. Recesses 15 are dimensioned to receive gaskets to secure the glazing panel in the convention manner.

During assembly of curtain wall frames in accordance with this invention, the transoms 2 may be simply engaged with the mullions 1 from the exterior of the latter, the formations 4 being received in the apertures 5 aligned with factory drilled fixing holes for the screws, making it unnecessary to perform this operation on-site.

The joint member 3 may be formed from one or more pieces. Use of a plurality of pieces may be preferred to facilitate molding of the block. The pieces may either be fastened together, for example by rivets, or may be arranged to be held together when the walling is assembled.

I claim:

1. A curtain wall system, comprising;

a vertical member;

a joint member including means for fastening said joint member to said vertical member and a projection member extending transversely to said vertical member in a horizontal orientation and having bearing surfaces extending horizontally;

a horizontal member of extended length, said horizontal member being contoured in cross-section to slidingly receive and retain said projection member telescopically and at least partially within said horizontal member in the length direction of said horizontal member; and a low friction layer portioned on the bearing surfaces of said projection member for facilitating sliding motion between said projection member and said horizontal member, said horizontal member and said joint member being subject to relative motion upon thermal expansion or contraction of the horizontal member.

2. A system as claimed in claim 1 in which the horizontal member is a transom.

3. A system as claimed in claim 2 in which the low friction layer is a covering of plastics material.

4. A system as claimed in claim 3 in which the plastics material is polethylene, polypropylene, nylon or polytetrafluoroethylene.

5. A system as claimed in claim 4 in which said means for fastening includes apertures through which screws, bolts, rivets or other fixtures are engaged with the vertical member.

6. A system as claimed in claim 1 in which the low friction layer is a covering of plastics material.

7. A system as claimed in claim 2 in which said means for fastening includes apertures through which screw, bolts, rivets or other fixtures are engaged with the vertical member.

8. A system as claimed in claim 3 in which said means for fastening includes apertures through which screw, bolts, rivets or other fixtures are engaged with the vertical members.

9. A system as claimed in claim 1 in which said means for fastening includes apertures through which screws, bolts, rivets or other fixtures are engaged with the vertical member.

10. A system as claimed in claim 1, wherein said low friction layer is a hollow, separable member, said projection member being telescopically received within said low friction member.

* * * * *